US005975677A

United States Patent [19]

Marler et al.

[11] Patent Number: 5,975,677

[45] Date of Patent: Nov. 2, 1999

[54] MULTIPLE CARTRIDGE PRINTHEAD ASSEMBLY FOR USE IN AN INKJET PRINTING SYSTEM

[75] Inventors: Jaren D. Marler; Ted Lee, both of Escondido; Winthrop D. Childers, San Diego, all of Calif.; Preston D. Seu, Vancouver, Wash.; Norman E. Pawlowski, Jr., Corvallis, Oreg.

[73] Assignee: Hewlett-Packard Co., Palo Alto, Calif.

[21] Appl. No.: 08/846,969

[22] Filed: Apr. 30, 1997

[51] Int. Cl.[6] ..... B41J 2/145; B41J 2/15

[52] U.S. Cl. ..... 347/40

[58] Field of Search ..... 347/40, 49, 19

[56] References Cited

U.S. PATENT DOCUMENTS

| | | | |
|---|---|---|---|
| 4,313,684 | 2/1982 | Tazaki | 400/322 |
| 4,490,728 | 12/1984 | Vaught . | |
| 5,049,898 | 9/1991 | Arthur et al. | 347/19 |
| 5,148,194 | 9/1992 | Asai et al. | 347/49 |
| 5,278,584 | 1/1994 | Keefe . | |
| 5,408,746 | 4/1995 | Thoman | 29/890.1 |
| 5,661,510 | 8/1997 | Brandon et al. | 347/87 |
| 5,739,830 | 4/1998 | John et al. | 347/49 |

FOREIGN PATENT DOCUMENTS

| | | | |
|---|---|---|---|
| 421806 | 4/1991 | European Pat. Off. | B41J 2/21 |

OTHER PUBLICATIONS

Durbeck, R.C. and S. Sherr, eds., "Inkjet Devices" Chapter 13 of Output Hardcopy Devices, 1988, Academic Press.
Hewlett–Packard Journal, vol. 36, No. 5 (May 1985).
Hewlett–Packard Journal, vol. 39, No. 4 (Aug. 1988).
Hewlett–Packard Journal, vol. 39, No. 5 (Oct. 1988).
Hewlett–Packard Journal, vol. 43, No. 4 (Aug. 1992).
Hewlett–Packard Journal, vol. 43, No. 6 (Dec. 1992).
Hewlett–Packard Journal, vol. 45, No. 1 (Feb. 1994).

*Primary Examiner*—N. Le
*Assistant Examiner*—L. Anderson
*Attorney, Agent, or Firm*—Dennis G. Stenstrom

[57] ABSTRACT

Described is a printing system including a first array of ink ejection elements formed on a first substrate surface for ejecting droplets of a first ink, a second array of ink ejection elements formed on a second substrate surface for ejecting droplets of a second ink, a memory element associated with the first and second arrays of ink ejection elements contains parameters that relate droplet ejection characteristics of the first and second array of ink ejection elements. The droplet ejection characteristics may contain ink ejection alignment data that enables the calculation of the relative alignment between the first and second arrays of ink ejection elements such that droplets of the first ink can be effectively aligned with droplets of the second ink. Also, ink droplet volume data enables the calculation of the relative drop volume between the first and second arrays of ink ejection elements such that the printing system can provide hue control.

8 Claims, 13 Drawing Sheets

MULTIPLE CARTRIDGE PRINTHEAD ASSEMBLY FOR USE IN AN INKJET PRINTING SYSTEM

FIELD OF THE INVENTION

This invention relates to inkjet printers and, more particularly, to an inkjet printer having a multiple cartridge printhead assembly.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Color inkjet hardcopy devices commonly employ a plurality of print cartridges, usually two to four, mounted in the printer carriage to produce a full spectrum of colors. In a printer with four cartridges, each print cartridge can contain a different color ink, with the commonly used base colors being cyan, magenta, yellow, and black. In a printer with two cartridges, one cartridge can contain black ink with the other cartridge being a tri-compartment cartridge containing the base color cyan, magenta and yellow inks, or alternatively, two dual-compartment cartridges may be used to contain the four color inks. In addition, two tri-compartment cartridges may be used to contain six base color inks, for example, black, cyan, magenta, yellow, light cyan and light magenta. Further, other combinations can be employed depending on the number of different base color inks to be used.

The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

For many applications, such as personal computer printers and fax machines, the ink reservoir has been incorporated into the pen body such that when the pen runs out of ink, the entire pen, including the printhead, is replaced.

However, for other hardcopy applications, such as large format plotting of engineering drawings, color posters and the like, there is a requirement for the use of much larger volumes of ink than can be contained within the replaceable pens. Therefore, various off-board ink reservoir systems have been developed recently which provide an external stationary ink supply connected to the scanning cartridge via a tube. The external ink supply is typically known as an "off-axis," "off-board," or "off-carriage" ink supply. While providing increased ink capacity, these off-carriage systems also present a number of problems.

These various problems include accurate and inexpensive methods of alignment of the multiple print cartridges, providing a reliable fluid seal between the print cartridge and the external ink supply and providing electrical connections between the print cartridge and the printer.

When using a printhead with a large number of nozzles and high resolution, correct alignment of all the nozzles so that the ink is correctly placed on the print media is extremely important. Dot alignment must be done in both the horizontal and vertical axes. The horizontal axis is generally referred to as the scan axis. The vertical axis is generally referred to as the paper advance axis. Many factors can affect alignment. For example, slight variations during manufacturing can affect alignment. Additionally, the alignment of ink placed on a page can be dynamically affected during printing, for example dependent on the volume of a drop which is generated by merged droplets.

In color printing, the various colored dots produced by each of the print cartridges are selectively overlapped to create crisp images composed of virtually any color of the visible spectrum. To create a single dot on paper having a color which requires a blend of two or more of the colors provided by different print cartridges, the nozzle plates on each of the cartridges must be precisely aligned so that a dot ejected from a selected nozzle in one cartridge overlaps a dot ejected from a corresponding nozzle in another cartridge. This requires each of the nozzle plates on the print cartridges to be aligned with respect to one another within a few tens of microns after being installed in the carriage.

One method of accomplishing this is to make the print cartridge bodies identical to one another so that, when multiple print cartridges were installed in the carriage, the print cartridge bodies were all aligned with one another in the carriage irrespective of any misalignment of the nozzle plates secured to the print cartridge bodies. To align the nozzle plate on a print cartridge so that nozzle plates are positioned in ideally the same location on all the various print cartridges, the nozzle plate is typically glued in position on the print cartridge relative to a molded-in plastic datum formed on the print cartridge body. This alignment process has a significant drawback in that the glue curing process causes the nozzle plate to slightly shift as the glue is being cured. In addition, molded-in stresses in the plastic cartridge body creep during the thermal curing process. Since this movement is substantially unpredictable, this alignment and gluing process can only produce print cartridges of minimal accuracy.

Other, more expensive techniques have been used to achieve higher alignment precision. One of these techniques automatically detects any misalignment of the nozzle plates once the print cartridges have been installed in a carriage and then mechanically adjusts the positions of the print cartridges in the carriage. Using another relatively expensive method, an ink drop detector within the ink printer measures the location of a drop of ejected ink after being ejected from a nozzle, and a software algorithm compensates for any misalignment of the nozzle plates. Both of these techniques significantly increase the cost of the ink printer.

Achieving accurate mechanical alignment between printheads using in-printer latching is very difficult and costly. Moreover, typically the desired alignment is not achieved and further ways of adjusting are used. For example, the user can print a test plot with the four pens, and then type in a code that sets an alignment algorithm in the printer. This is inconvenient and users rarely do this and print quality suffers.

Multichamber printheads which use a single substrate, typically a single piece of silicon, with multiple ink feed slots help solve the above problems, but there are still trajectory and drop volume variations within a multichamber cartridge. In addition, the multichamber printhead requires that all nozzles be on the same substrate, thus, upper limits on silicon die size limit the performance of multichamber cartridge systems.

Thus, there is needed is an accurate method of assuring precise dot-to-dot registration between multiple colorants in an inkjet printer.

SUMMARY OF THE INVENTION

In a first embodiment there is provided a printing system including a first array of ink ejection elements formed on a first substrate surface for ejecting droplets of a first ink, a second array of ink ejection elements formed on a second substrate surface for ejecting droplets of a second ink, a memory element associated with the first array of ink ejection elements and the second array of ink ejection elements, the memory element containing parameters that relate droplet ejection characteristics of the first array of ink ejection elements and the second array of ink ejection elements and a support structure for supporting the first and second arrays of ink ejection elements.

In a second embodiment there is provided a printing system including a first array of ink ejection elements formed on a first substrate surface for ejecting droplets of a first ink, a second array of ink ejection elements formed on a second substrate surface substantially coplanar with the first substrate surface for ejecting droplets of a second ink, a first housing for separately routing the first ink to the first array of ink ejection elements attached to the first housing, a second housing for separately routing the second ink to the second array of ink ejection elements attached to the second housing and an integral support structure rigidly attaching the first and second housings.

Provided is a method of assembling a printing system, including the steps of providing a first array of ink ejection elements formed on a first substrate surface for ejecting droplets of a first ink, providing a second array of ink ejection elements formed on a second substrate surface for ejecting droplets of a second ink and forming a printhead assembly by rigidly connecting the first and second array of ink ejection elements in a fixed relative alignment. A method of assembling a printing system, including the steps of providing a first array of ink ejection elements formed on a first substrate surface for ejecting droplets of a first ink, providing a second array of ink ejection elements formed on a second substrate surface substantially coplanar with the first substrate surface for ejecting droplets of a second ink, providing a first housing for separately routing the first ink to the first array of ink ejection elements attached to the first housing and a second housing for separately routing the second ink to the second array of ink ejection elements attached to the second housing and forming a printhead assembly by rigidly attaching the first and second the first and second housings in a fixed relative alignment. The above methods may also include the steps of testing the printhead assembly to obtain parameters that relate droplet ejection characteristics of the first array of ink ejection elements and the second array of ink ejection elements, providing a memory element associated with the first array of ink ejection elements and the second array of ink ejection elements and recording on the memory element the parameters that relate droplet ejection characteristics of the first array of ink ejection elements and the second array of ink ejection elements.

DETAILED DESCRIPTION OF THE PREFERRED EMBODIMENTS

A method and apparatus for providing a printing system with precisely aligned and sized colorant ink ejection elements includes assembling the individual colorant ink ejection elements together into a rigid multiple cartridge printhead assembly. A preferred method for doing this is to provide a plurality of nearly identical colorant ink ejection elements, each colorant ink ejection elements having a housing and a printhead for ejecting a particular ink and then aligning and rigidly fastening these printing elements together. The resulting multiple cartridge printhead assembly having colorant to colorant alignment already established can then be installed in a carriage.

To further enhance the performance, the printing system corrects for any remaining variation in the printing elements. A preferred way to do this is to provide a memory element that is replaced with the multiple cartridge printhead assembly, the memory element includes colorant to colorant trajectory and drop volume data to allow for precise dot-to-dot registration and hue control.

Figure 1:
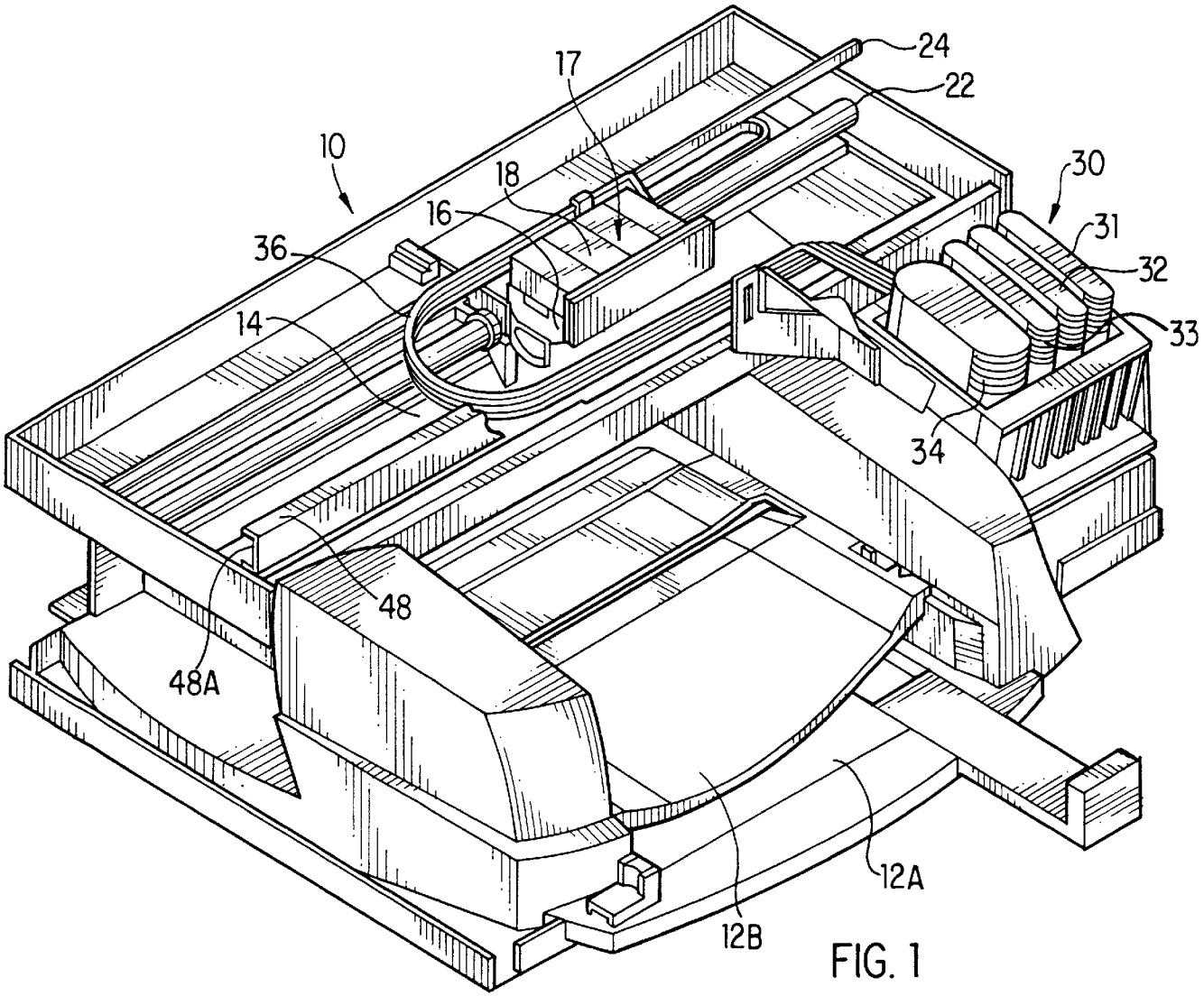
FIG. 1 is a perspective view of one embodiment of an inkjet printer incorporating the multiple cartridge printhead assembly of the present invention.

While the multiple cartridge printhead assembly of the present invention will be described below in the context of an off-axis printer having an external ink source, it should be apparent that the present invention is also useful in an inkjet printer which uses inkjet print cartridges having an ink reservoir integral with the print cartridge. An example of such print cartridges is described in U.S. Patent No. 5,278,584, by Brian Keefe, et al., entitled "Ink Delivery System for an Inkjet Printhead," assigned to the present assignee and incorporated herein by reference. FIG. 1 is a perspective view of one embodiment of an inkjet printer 10 suitable for utilizing the multiple cartridge printhead assembly of the present invention, with its cover removed. Generally, printer 10 includes a tray 12 for holding virgin paper. When a printing operation is initiated, a sheet of paper from tray 12A is fed into printer 10 using a sheet feeder, then brought around in a U direction to now travel in the opposite direction toward tray 12B. The sheet is stopped in a print zone 14, and a scanning carriage 16, supporting multiple cartridge printhead assembly 17 containing one or more print cartridges 18, is then scanned across the sheet for printing a swath of ink thereon. After a single scan or multiple scans, the sheet is then incrementally shifted using a conventional stepper motor and feed rollers to a next position within the print zone 14, and carriage 16 again scans across the sheet for printing a next swath of ink. When the printing on the sheet is complete, the sheet is forwarded to a position above tray 12B, held in that position to ensure the ink is dry, and then released.

The carriage 16 scanning mechanism may be conventional and generally includes a slide rod 22, along which carriage 16 slides, a flexible circuit (not shown in FIG. 1) for transmitting electrical signals from the printer's microprocessor to the carriage 16 and print cartridges 18 and a coded strip 24 which is optically detected by a photodetector in carriage 16 for precisely positioning carriage 16. A stepper motor (not shown), connected to carriage 16 using a conventional drive belt and pulley arrangement, is used for transporting carriage 16 across print zone 14.

The features of inkjet printer 10 include an ink delivery system for providing ink to the print cartridges 18 and ultimately to the ink ejection chambers in the printheads from an off-axis ink supply station 30 containing replaceable ink supply cartridges 31, 32, 33, and 34, which may be pressurized or at atmospheric pressure. For color printers, there will typically be a separate ink supply cartridge for black ink, yellow ink, magenta ink, and cyan ink. Four tubes 36 carry ink from the four replaceable ink supply cartridges 31–34 to the print cartridges 18.

Figure 3:
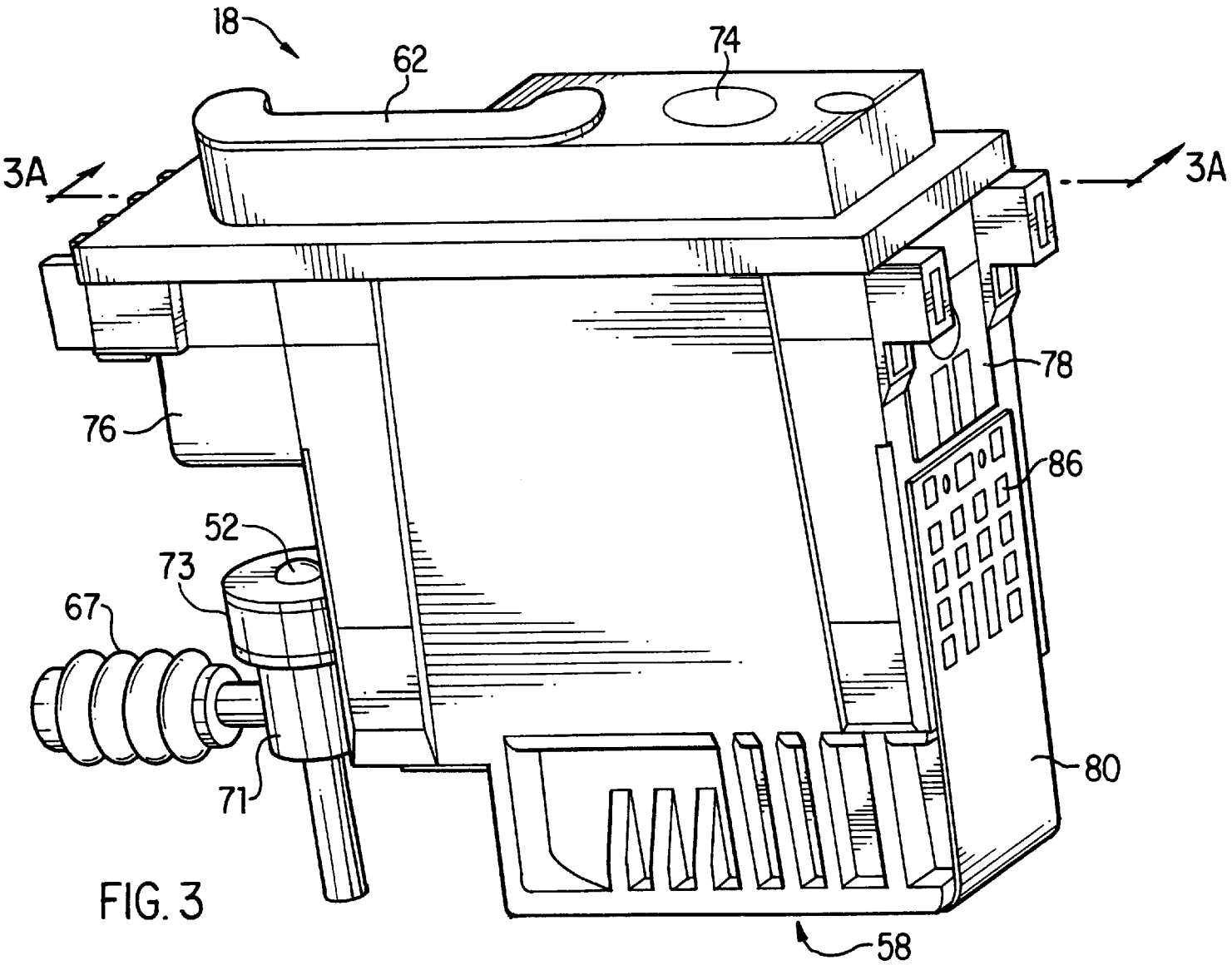
FIG. 3 is a perspective view of a single print cartridge, before assembly into a multiple cartridge printhead assembly, and showing the fluid interconnect portion of the carriage.

FIG. 3 is a perspective view of one embodiment of a print cartridge 18 of multiple cartridge printhead assembly 17. A shroud 76 surrounds needle 60 (obscured by shroud 76) to prevent inadvertent contact with needle 60 and also to help align septum 52 with needle 60 when installing print cartridge 18 in carriage 16. A flexible tape 80 containing contact pads 86 leading to the printhead substrate is secured to print cartridge 18. These contact pads 86 align with and electrically contact electrodes 49 (FIG. 3A) on carriage 16. Preferably, the electrodes on carriage 16 are resiliently biased toward print cartridge 18 to ensure a reliable contact. Such carriage electrodes are found in U.S. Pat. No. 5,408,746, entitled Datum Formation for Improved Alignment of Multiple Nozzle Members in a Printer, by Jeffrey Thoman et al., assigned to the present assignee and incorporated herein by reference.

The printhead nozzle array is at location 58. An integrated circuit chip or memory element 78 provides feedback to the printer regarding certain parameters such as nozzle trajectories and drop volumes of print cartridge 18. The storage of data on memory element 78 and the use of memory element 78 by the printing system is discussed in detail below.

Figure 4:
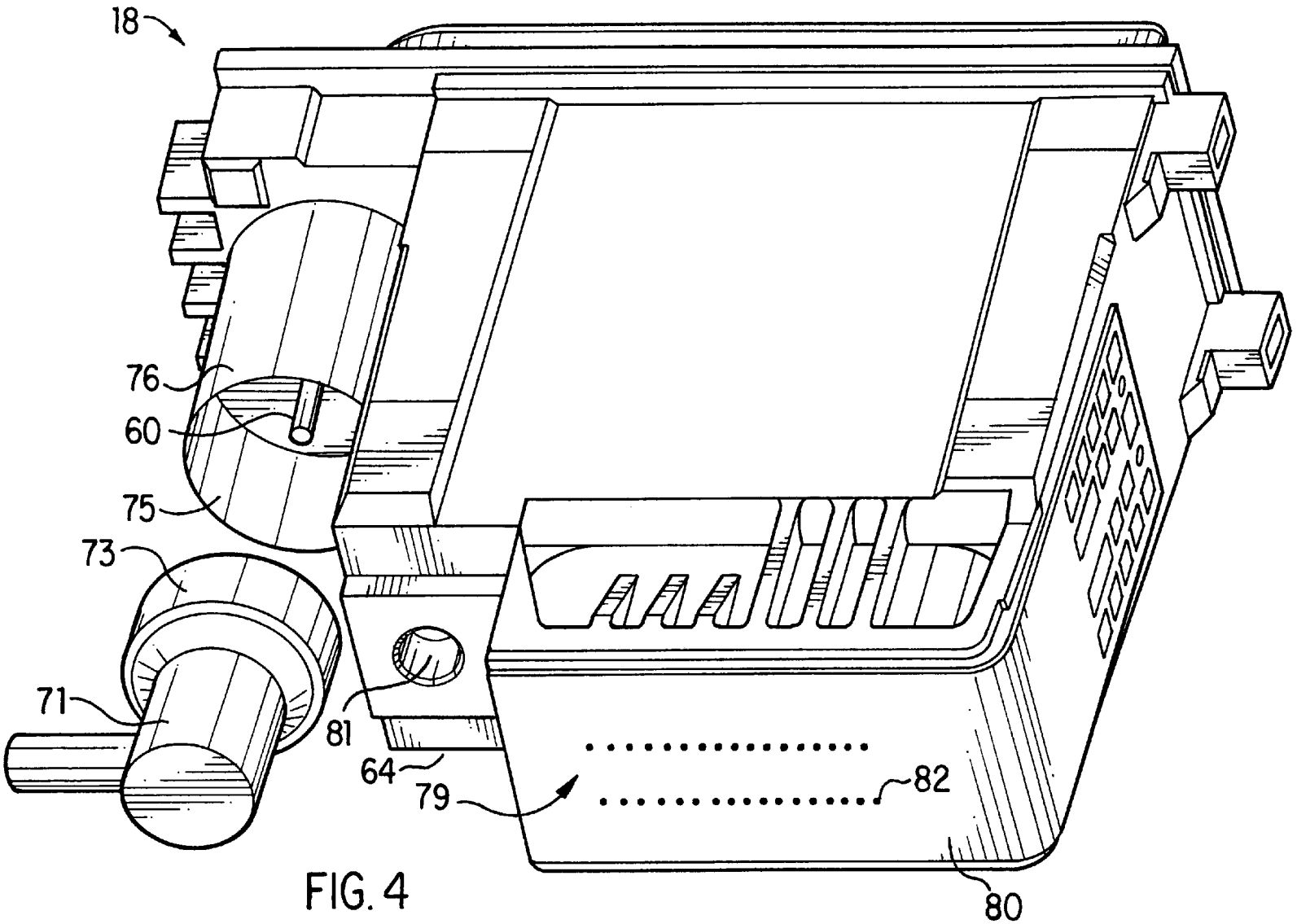
FIG. 4 is another perspective view a single print cartridge, before assembly into a multiple cartridge printhead assembly, and the fluid interconnect portion of the carriage.

FIG. 4 illustrates the bottom side of print cartridge 18. Two parallel rows of offset nozzles 82 are shown laser ablated through tape 80. An ink fill hole 81 is used to initially fill print cartridge 18 with ink. A stopper (not shown) is intended to permanently seal hole 81 after the initial filling.

Figure 5:
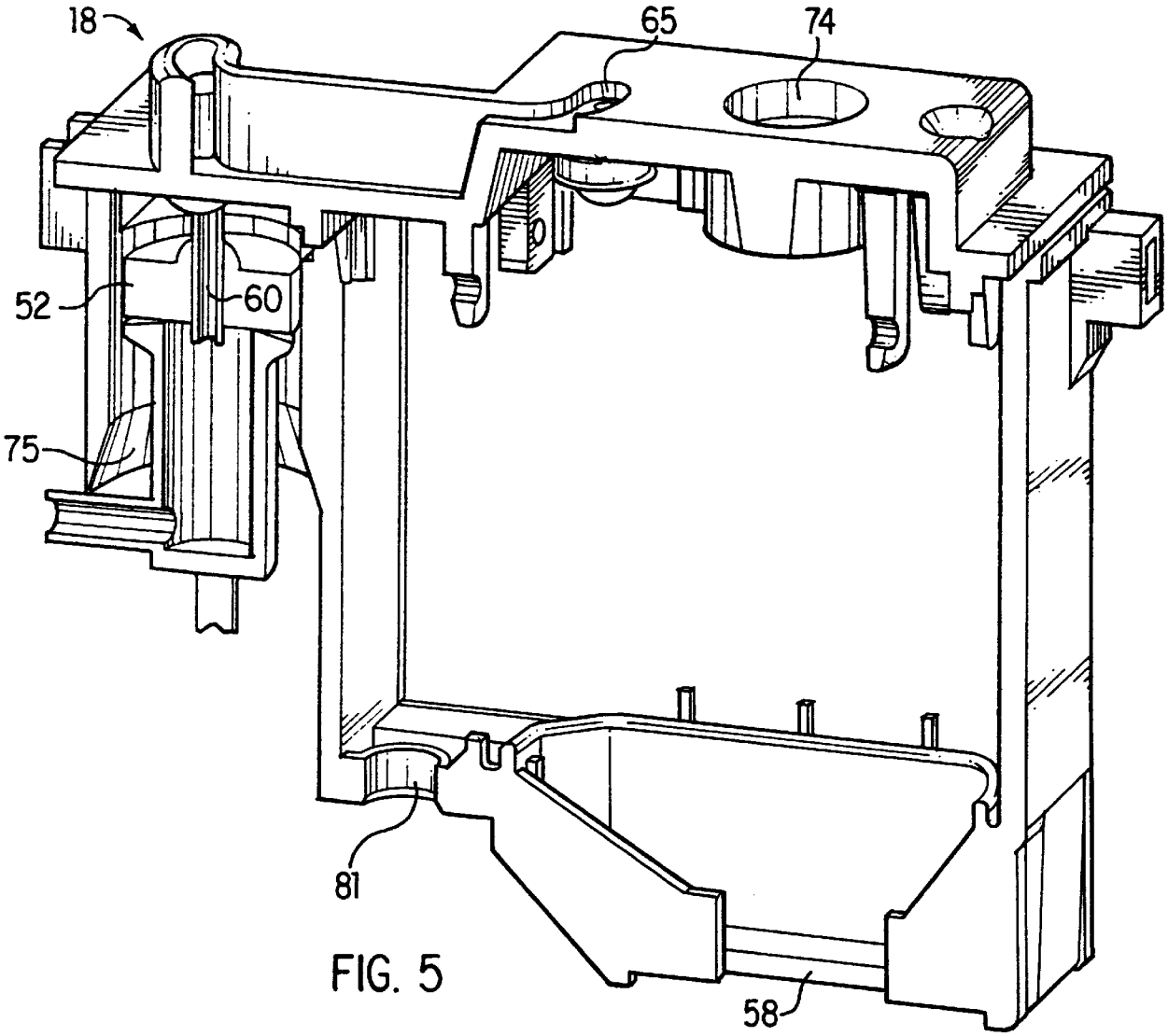
FIG. 5 is a cross-sectional view of the print cartridge of FIG. 5B shown connected to the fluid interconnect on the carriage.

FIG. 5 is a cross-sectional view of print cartridge 18, without tape 80, taken along line 5A—5A in FIG. 3. Shroud 76 is shown having an inner conical or tapered portion 75 to receive septum 52 and center septum 52 with respect to needle 60. In an alternative embodiment, needle 60 is part of a separate subassembly, and shroud 76 is a separate subassembly, for manufacturing ease.

A regulator valve (not shown) within print cartridges 18 regulates pressure by opening and closing an inlet hole 65 to ink chamber 61 internal to print cartridges 18. For a description of the design and operation of the regulator see U.S. patent application Ser. No. 08/706121, filed Aug. 30, 1996, entitled "Inkjet Printing System with Off-Axis Ink Supply Having Ink Path Which Does Not Extend above Print Cartridge," which is herein incorporated by reference.

When the regulator valve is opened, a hollow needle 60 is in fluid communication with an ink chamber 61 internal to the cartridge 18. The needle 60 extends through a self-sealing hole formed in through the center of the septum 52. The hole is automatically sealed by the resiliency of the rubber septum 52 when the needle is removed. A plastic conduit 62 leads from the needle 60 to chamber 61 via hole 65. The conduit may be glued, heat-staked, ultrasonically welded or otherwise secured to the print cartridge body. The conduit may also be integral to the print cartridge body.

A septum elbow 71 routes ink from the manifold 66 to the septum 52, and supports the septum. The septum is affixed to the elbow using a crimp cap. The coupler 67 in this exemplary embodiment is a flexible bellows for allowing a degree of x, y and z movement of the septum 52 when the needle 60 is inserted into the septum to minimize the load on the needle and ensure a fluid-tight and air-tight seal around the needle. The bellows may be formed of butyl rubber or other flexible material having low vapor and air transmission properties. Alternatively, the bellows can be replaced with a U-shaped or circular flexible tube. A spring 70 urges the septum 52 upwardly, allowing the septum to take up z tolerances, minimizes the load on the needle 60 and ensures a tight seal around the needle 60.

The print cartridges and ink supply connections described above are down-connect types where the ink connection is made when pressing the print cartridge down into the carriage. This enables a resulting printer to have a very low profile since the ink path does not extend above the print cartridge. In the embodiments shown having the needle extending from the print cartridge, the needle may be replaced with a septum, and the septum on the scanning carriage replaced with a hollow needle.

When in use in the printer 10, the print cartridges 18 of multiple cartridge printhead assembly 17 are in fluid communication with an off-carriage ink supply 31–34 that is releasably mounted in an ink supply station 30. Without this fluid communication, the new off-axis design print cartridges have very little internal ink capacity in their reservoirs and these print cartridges 18 can expel only approximately 1 cc of ink.

Figure 6:
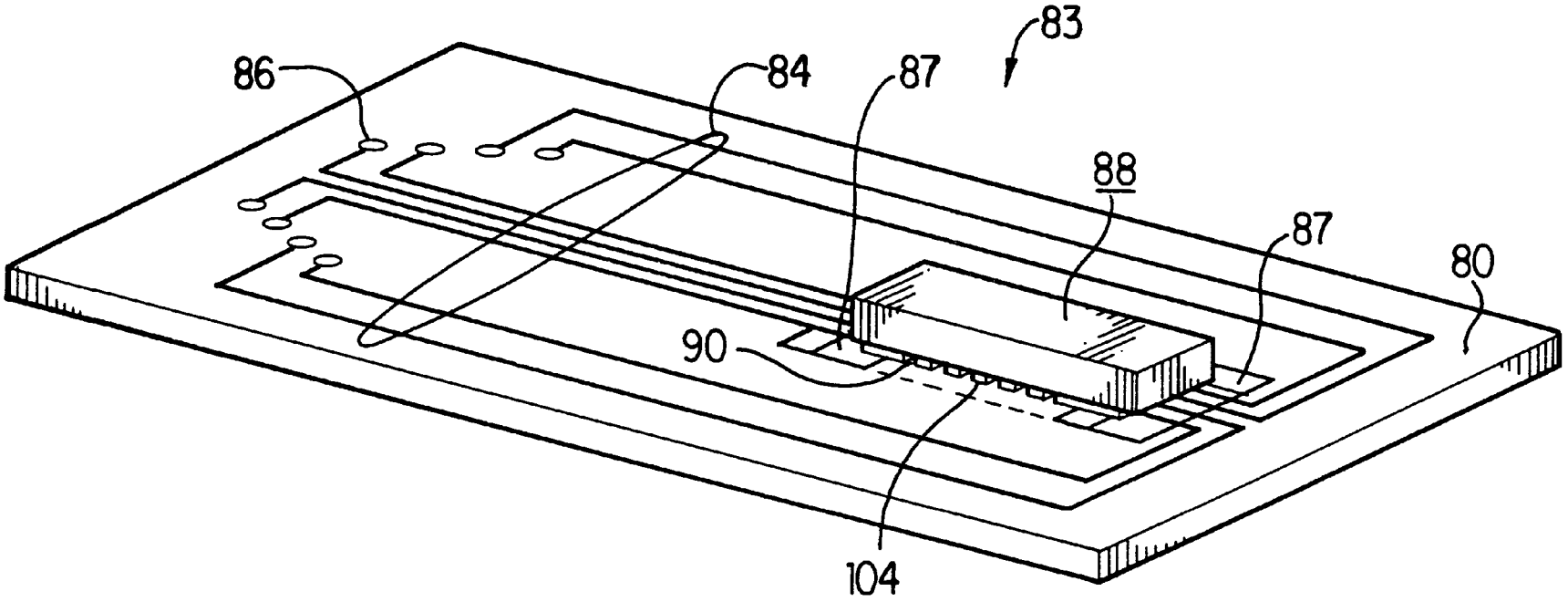
FIG. 6 is a perspective view of the back side of the printhead assembly.

Referring to FIGS. 4 and 6, printhead assembly 83 is preferably a flexible polymer tape 80 having nozzles 82 formed therein by laser ablation. Conductors 84 are formed on the back of tape 80 and terminate in contact pads 86 for contacting electrodes on carriage 16. The other ends of conductors 84 are bonded through windows 87 to terminals of a substrate 88 on which are formed the various ink ejection chambers and ink ejection elements. The ink ejection elements may be heater resistors or piezoelectric elements.

A demultiplexer on substrate 88 demultiplexes the incoming electrical signals applied to contact pads 86 and selectively energizes the various ink ejection elements to eject droplets of ink from nozzles 82 as printhead 79 scans across the print zone. In one embodiment, the dots per inch (dpi) resolution is 300 dpi, and there are 300 nozzles 82. In another embodiment, at least the black ink cartridge prints at a resolution of 600 dpi.

The printhead assembly may be similar to that described in U.S. Pat. No. 5,278,584, by Brian Keefe, et al., entitled "Ink Delivery System for an Inkjet Printhead," assigned to the present assignee and incorporated herein by reference. In such a printhead assembly, ink within print cartridge 18 flows around the edges of the rectangular substrate 88 and into ink channels 90 leading to each of the ink ejection chambers.

Figure 7:
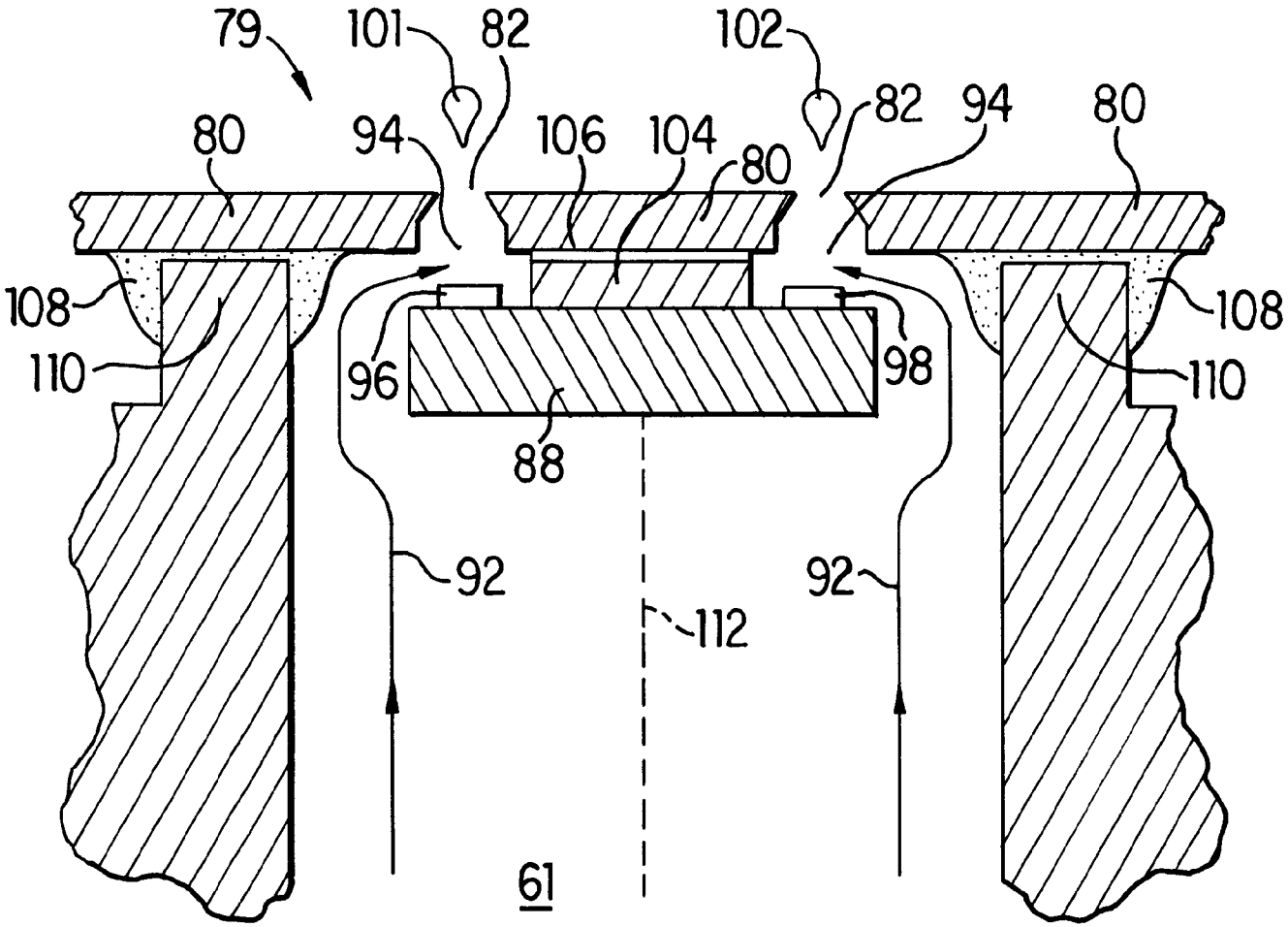
FIG. 7 is a cross-sectional view of the portion of the multiple cartridge printhead assembly containing the printhead assembly showing the flow of ink to the ink ejection chambers in the printhead.

FIG. 7 illustrates the flow of ink 92 from the ink chamber 61 within print cartridge 18 to ink ejection chambers 94. Energization of the ink ejection elements 96 and 98 cause a droplet of ink 101, 102 to be ejected through the associated nozzles 82. A photoresist barrier layer 104 defines the ink channels and chambers, and an adhesive layer 106 affixes the flexible tape 80 to barrier layer 104. Another adhesive 108 provides a seal between tape 80 and the plastic print cartridge body 110. In one embodiment, a wall 112 separates the ink flow paths around the two edges of substrate 88, and a different color ink is supplied to each side of wall 112. The conductor portion of the flexible tape 80 is glued or heat-staked to the print cartridge body 110.

Figure 8:
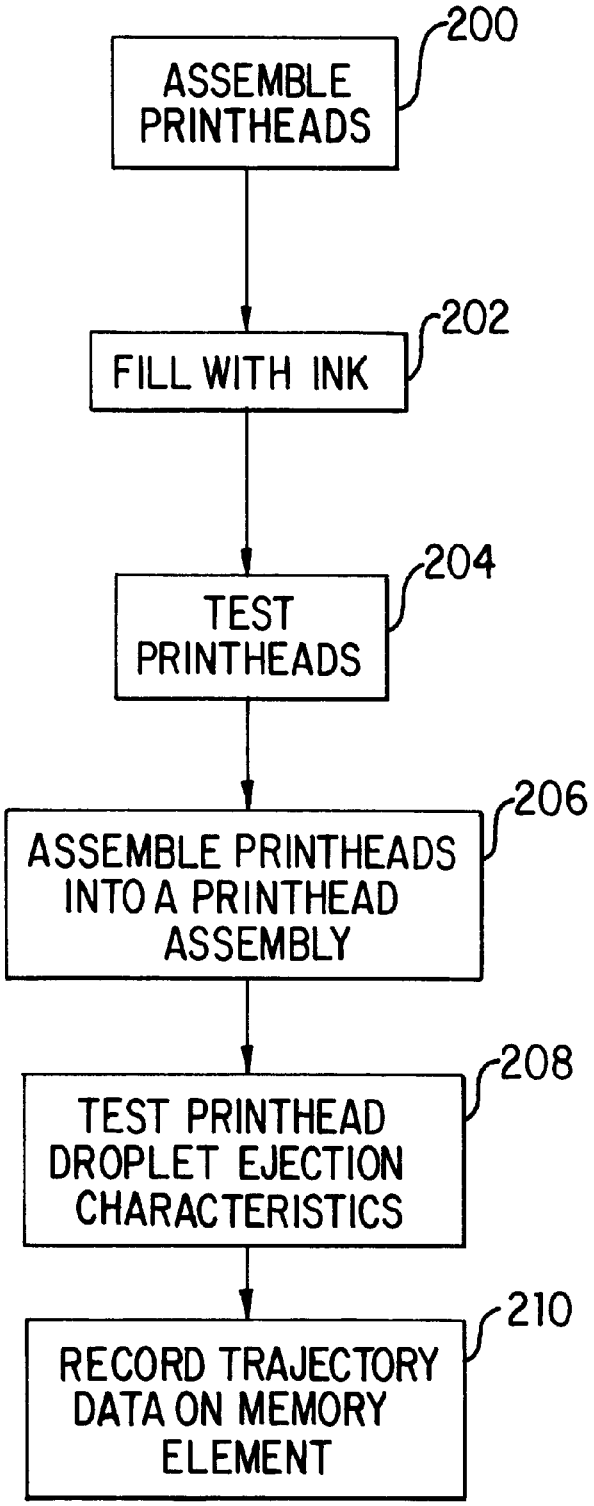
FIG. 8 is a flowchart showing the steps in the assembling of the multiple cartridge printhead assembly.

FIG. 8 illustrates the steps in the manufacture of multiple cartridge printhead assembly 17. In step 200, which is actually an entire series of assembly steps, each printhead cartridge 18 is assembled in accordance with standard assembly procedures. Preferably, memory element 78 is attached to printhead cartridge 18 during step 200.

In step 202, printhead cartridge 18 is filled with ink which may be black, cyan, magenta or yellow. In step 204, the quality of each print cartridge 18 is evaluated by an automated test tool. The objective of the tester is to exercise the print cartridge and measure its attributes with respect to print cartridge specifications. The two tests used to measure print cartridge quality are a machine vision analysis of printed images and the measurement of print cartridge electrical parameters.

The tester can be divided into four functional areas: print mechanism, vision analysis engine, electrical tester, and system controller. The print mechanism moves media beneath the print cartridge while the test pattern is being printed. Tensioning, supply, and take up are also managed by this mechanism. Once printed, test patterns are analyzed by the vision engine. CCD cameras supply images to the vision engine where they are processed and evaluated. Finally, the electrical tester verifies the print cartridge's electrical integrity. The results from both the vision engine and the electrical tester are sent to the system controller where they are collated and forwarded to the central line controller.

The machine readable print sample is composed of two primary patterns. One pattern is used to detect the print mode failures of banding and horizontal trajectory. The other pattern provides a means of analyzing individual nozzles for dot size and vertical trajectory. Dot size provides a rough estimate of a more significant parameter, drop volume. In addition, the fragile nature of the die and TAB beam attachments require electrical testing following print cartridge assembly. The interconnects are probed for open and short circuit conditions and for parametric measurements of special die features.

Print quality results depend heavily on the characteristics of the medium on which the patterns are printed. Print sample positioning within the camera field of view can vary based on the elasticity of the medium, requiring periodic camera adjustment. Moreover, variations in ink bleed along the medium fibers can complicate the issues of vision analysis.

The tester provides automated, closed-loop lighting level and color filtration adjustment. Programmable components are included to provide support for many different cartridges. Vision processing algorithms were developed that are insensitive to fluctuations in lighting and magnification levels, and that allow cycle-time improvements through the simple addition of off-the-shelf vision engines. Statistical tools were developed to analyze real-time system performance. With all programmable devices linked through a single workstation, it is possible to change individual components without pre-configuring them.

In step 206, the multiple printheads each usually having a different colorant are aligned to one another and then rigidly affixed together. The alignment can be accomplished with a automated vision system such as discussed above. Then, the printhead assemblies can be attached with adhesives, screws or other suitable affixing means.

Figure 9:
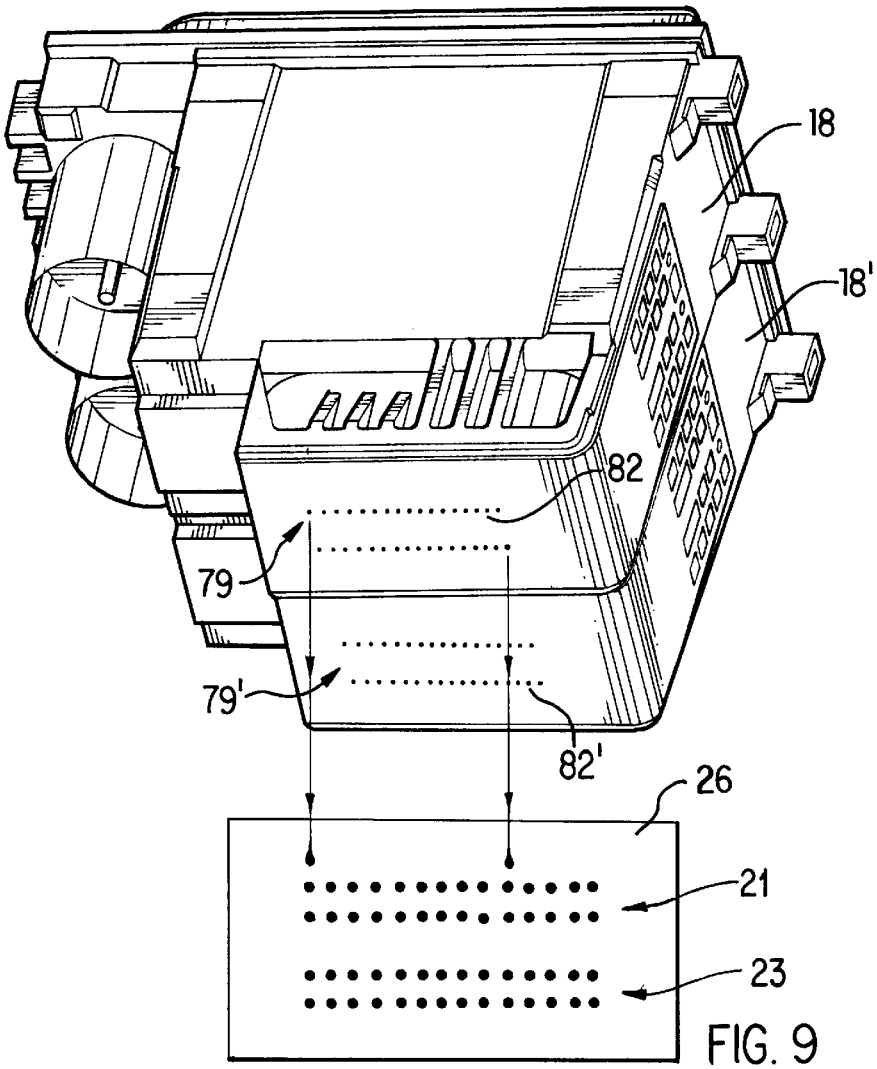
FIGS. 9 and 9A is a schematic showing two nozzle arrays ejecting different colorants on a media.
Figure 9A:
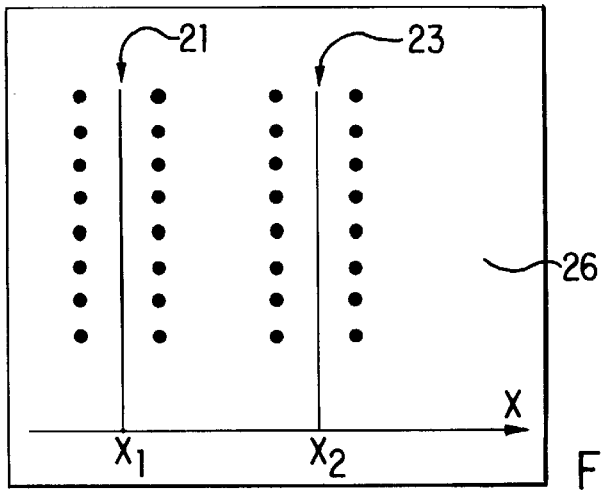

In step 208, relative droplet ejection characteristics are measured for each printhead in the printhead assembly using a camera vision system. One way to accomplish is to print a particular pattern of droplets of each colorant onto a controlled media, such as a specially formulated paper. This is illustrated in FIG. 9 for two printheads where printheads 79 and 79' eject colorants 21 and 23, respectively. As shown, each row of nozzles 82, 82' for a particular colorant prints a row of dots on a the controlled media forming two rows of dots for each colorant while the nozzles are stationary. This rows of dots are further illustrated in FIG. 9A.

Next, a camera vision system captures an image of the resultant rows of dots. The system then processes the image. For each colorant, an average x position is calculated for the pattern. In FIG. 9 for colorant 21 this referred to as $x_1$ and for colorant 23 this referred to as $x_2$. The value $x_2-x_1=d_{21}$ (measured) is indicative of the distance between printheads 79 and 79' along the x-axis. This value $d_{21}$ (measured) is compared to an expected or specified distance $d_{21}$ (specified) between the printheads. The difference $D_{12}=d_{21}$ (measured)$-d_{21}$ (specified) is the dot placement error for colorant 21 relative to colorant 23.

With a more detailed analysis of the dot locations, additional locational factors can be determined, such the specific dot placement errors for each dot by looking at the coordinates of individual dots and comparing these with expected locations. The procedures and the amount of analysis that is done depends on the placement precision requirements of the printing system and the storage capacity available on the information storage device 78.

When the measurements are complete, in step 210, the dot placement error measured in step 208 is recorded or encoded on memory element or information storage device 78. Preferably, other droplet ejection characteristics, such as printhead drop volume, energy required to energize the printhead and other printhead parameters are also recorded on memory element 78.

Figure 10:
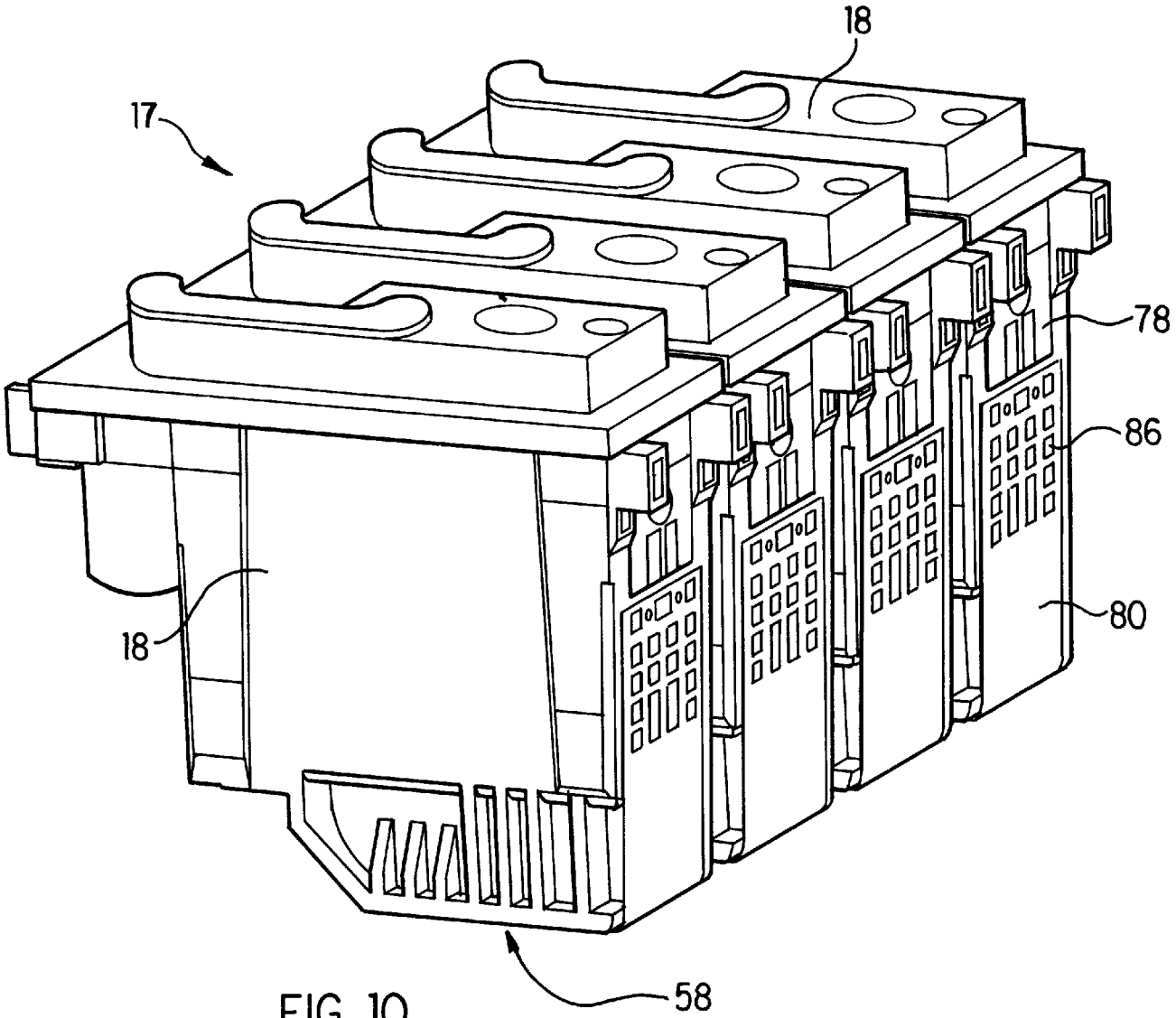
FIG. 10 is a perspective view of a multiple cartridge printhead assembly using the single print cartridge shown in FIG. 3.

FIG. 10 shows a full assembled multiple cartridge printhead assembly. Shown is the integrated circuit chip or memory element 78 on which is stored certain parameters such as nozzle trajectories and drop volumes of printhead 79 18. The use of memory element 78 by the printing system is discussed in detail below.

Figure 11:
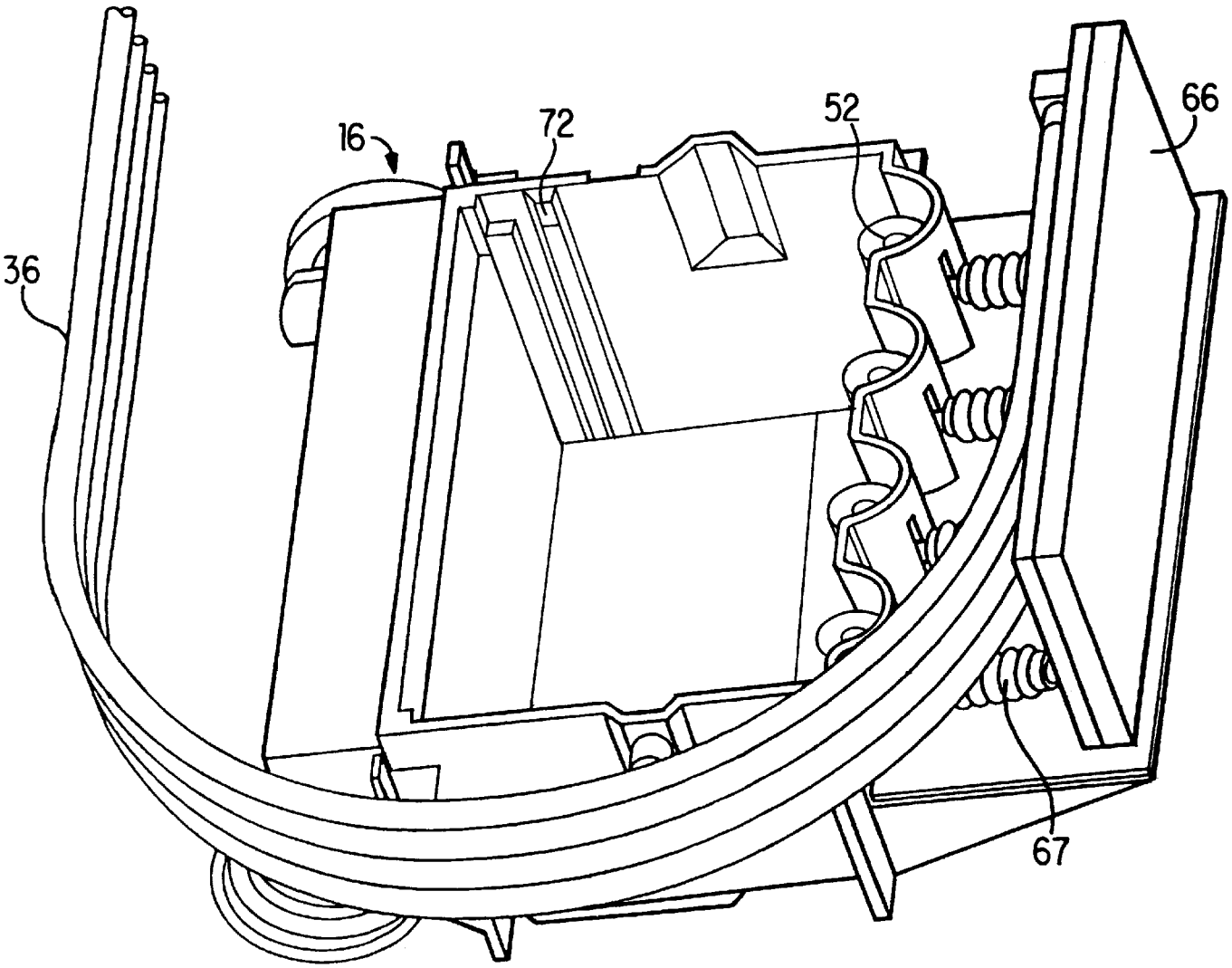
FIG. 11 is a perspective view looking down on the carriage of the printer shown in FIG. 2.

FIG. 11 is a perspective view of carriage 16 looking down on carriage 16. Ink is provided to carriage 16 by tubes 36 which connect to a plastic manifold 66. Tubes 36 may be formed of Polyvinylidene Chloride (PVDC), such as Saran™, or other suitable plastic. Manifold 66 provides several 90° redirections of ink flow. Such a manifold 66 may not be needed if tubes 36 are sufficiently slender and can be bent without buckling.

A septum elbow 71 (FIG. 3) routes ink from manifold 66 to septum 52 and supports septum 52. A bellows 67 (shown in cross-section) is provided for each of the individual stalls 68 for allowing a degree of x, y, and z movement of septum 52 when needle 60 is inserted into septum 52 to minimize the x, y, and z load on needle 60 and ensure a fluid-tight and air-tight seal around needle 60. Bellows 67 may be formed of butyl rubber, high acn nitrile, or other flexible material with low vapor and air transmission properties. Bellow 67 can be any length and can even be a flexible diaphragm.

A spring 70 urges septum 52 upward. This allows septum 52 to take up z tolerances, minimizes the load on needle 60, and ensures a tight seal around needle 60. Datums 72 formed in carriage 16 align and restrict movement of the multiple cartridge printhead assembly 17 in carriage 16. An air vent 74 formed in the top of print cartridge 18 is used by the pressure regulator in print cartridge 18 described above. In other embodiments bellows 67 may replaced with a U-shaped, circular, or straight flexible tube.

An opening in the bottom of the carriage 16 exposes the printhead location 58 of each print cartridge 18. Carriage electrodes (not shown) oppose contact pads 86 (shown in FIG. 3) located on print cartridges 18. Carriage electrodes are connected via an electrical flex circuit (not shown) to the printer's microprocessor which sends signals to control ink ejection. In an alternative embodiment the electrical flex circuit is connected directly to the print cartridges 18 by either electrical connectors or by being permanent soldering thereby eliminating the need and complexity of providing make/break connections on the carriage 16.

Figure 12:
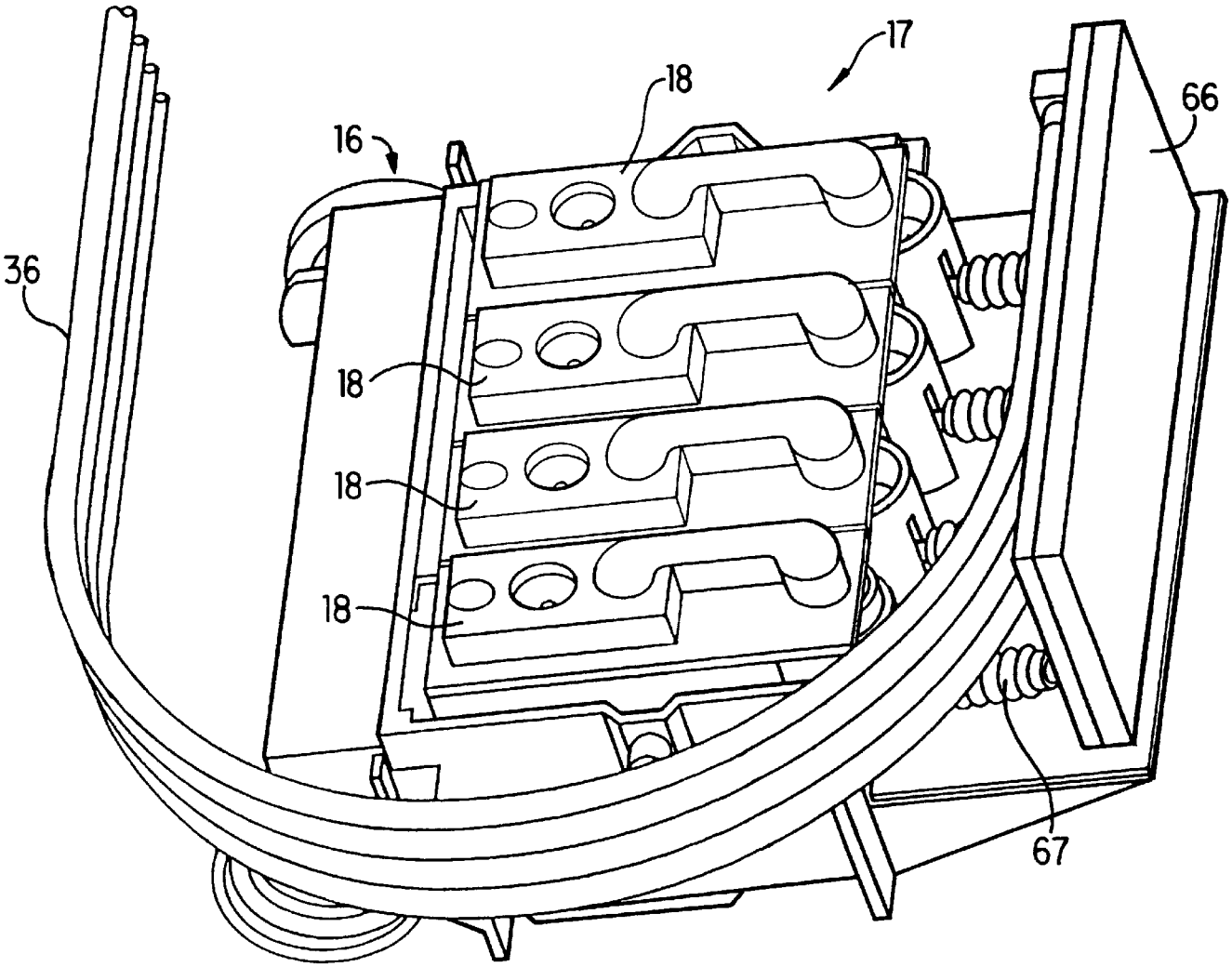
FIG. 12 is a perspective view looking down on a carriage of FIG. 9 with a multiple cartridge printhead assembly installed.

FIG. 12 is a perspective view looking down on a carriage of FIG. 10 with a multiple cartridge printhead assembly 17 installed.

Achieving accurate mechanical alignment between printheads using in-printer latching is very difficult and costly. A prior method of accomplishing this is to make the print cartridge bodies identical to one another so that, when multiple print cartridges were installed in the carriage, the print cartridge bodies were all aligned with one another in the carriage. However, plastic molding tolerances are difficult to control to the accuracy required. Also, latching offers limited accuracy.

The present invention makes the alignment between print cartridges when latched in the carriage simple and inexpensive since the cartridges are affixed together and pre-aligned with each other when the multiple cartridge printhead assembly 17 is assembled. Thus, the multiple cartridge printhead assembly 17 can be secured within the scanning carriage 16, by a single latch, such as a hinged bar, which may be manually operated or spring loaded, where the latch presses down on a tab or a corner of the multiple cartridge printhead assembly 17. This single simultaneous latching of all four print cartridges in the multiple cartridge printhead assembly 17.

Other embodiments of scanning carriages and print cartridges are described in U.S. patent application Ser. No. 08/706121, filed Aug. 30, 1996, entitled "Inkjet Printing System with Off-Axis ink Supply Having ink Path Which Does Not Extend above Print Cartridge," Attorney Docket No. 10960734, which is herein incorporated by reference.

The ink within each of the off-axis ink supply cartridges 31–34 may be at atmospheric pressure, whereby ink is drawn into each of print cartridges 18 by a negative pressure within each print cartridge determined by a regulator internal to each print cartridge as discussed above. Alternatively, the off-axis ink supply cartridges may be pressurized. In either the unpressurized or pressurized ink supply embodiments, a pressure regulator is used within the print cartridge for regulating the pressure of the ink chamber within the print cartridge. The regulator causes the ink chamber within the print cartridge to have a slight, but substantially constant, negative pressure (e.g., −2 to −7 inches of water column) to prevent ink drool from the nozzles of the printhead. One embodiment of a pressure regulator is described in U.S. patent application Ser. No. 08/706121, filed Aug. 30, 1996, entitled "Inkjet Printing System with Off-Axis ink Supply Having ink Path Which Does Not Extend above Print Cartridge," which is herein incorporated by reference.

Figure 2:
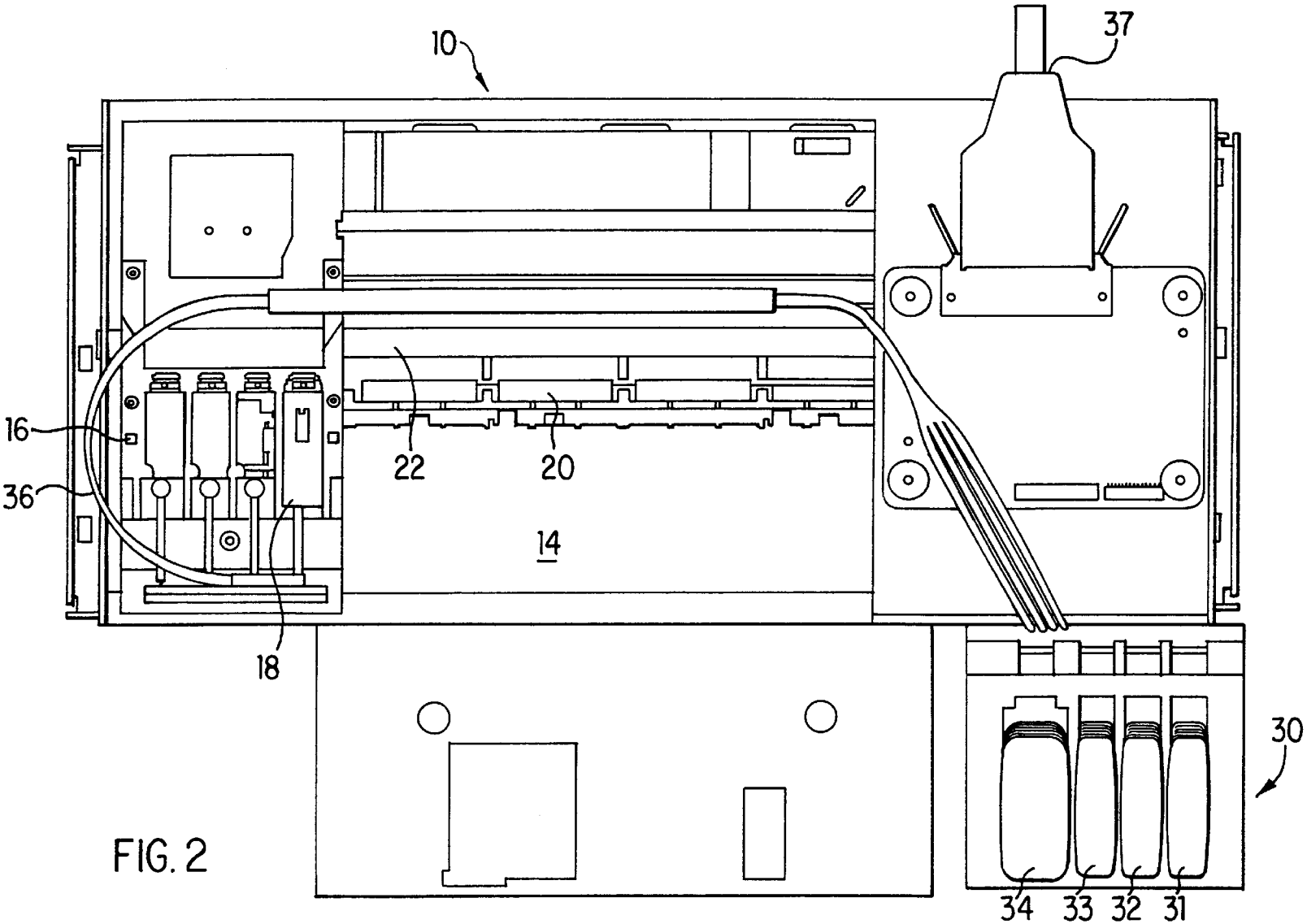
FIG. 2 is a simplified, partial top view of another embodiment of an inkjet printer incorporating the multiple cartridge printhead assembly of the present invention, but illustrating a different routing of the ink supply tubes from the off-axis ink reservoirs to the carriage-mounted ink cartridges.
Figure 13:
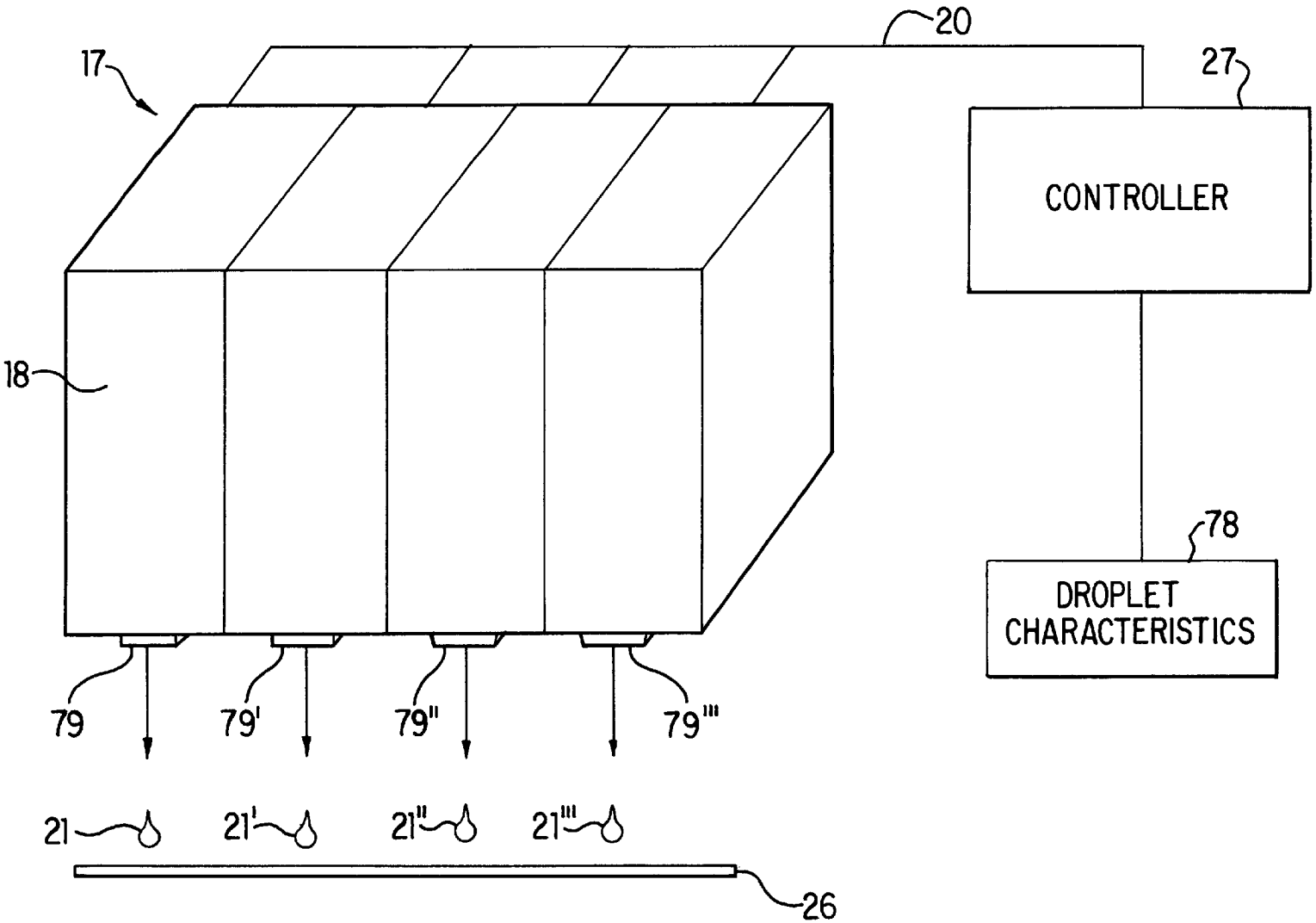
FIG. 13 is a schematic representation of the printing system of FIGS. 1 and 2.

FIG. 13 is a schematic representation of the inkjet printing system of FIGS. 1 and 2. Printhead assembly 17 includes a plurality printheads 79, 79', 79", 79''' positioned and aligned for ejecting ink on media 26. Controller 27 provides signals to printheads 79–79''' by way of electronic link 20.

Printhead assembly 17 ejects a plurality of colorants, each printhead 79 ejecting a different colorant 21, 21', 21", 21'''. As an example, printhead assembly 17 may include four printheads 79–79' that eject black, cyan, yellow and magenta inks, respectively. Each of printheads 79–79''' is mounted to a cartridge housing 18.

The present invention concerns a way of assuring that droplets 36 are properly aligned. In order to assure high image quality, it is critical that droplets of different colorants 21–21''' are properly aligned to one another. To illustrate this requirement, consider the example wherein printhead assembly 17 includes a cyan printhead, a yellow printhead, and a magenta printhead. In order to produce a green dot on media sheet 26, a yellow and cyan droplet may be ejected to the same location on media sheet 26. Failure to align the different colorants accurately would result in improper colors in improper locations.

To achieve this alignment, the present invention includes a combination of a mechanical aligning methods for aligning print cartridges 18 together along with an electronic timing method to assure proper alignment of different colorant droplets from different printheads in printhead assembly 17 relative to one another.

The mechanical method includes permanently affixing printheads 18 relative to one another. Permanent alignment can be done in a factory with a vision system. This eliminates the inaccuracies associated with mechanically latching each printhead housing 18 separately.

A preferred embodiment of this mechanical method is the case where housings 18 are separately fabricated as complete monochrome printheads. These printheads 79 are manufactured, filled with ink, and separately tested to assure that they eject droplets. Then, they are assembled into the printhead assembly 17.

Controller 27 provides signals for drop ejection that are precisely timed to assure colorant to colorant alignment. This relies on knowledge of the relative positioning of printheads 79 in printhead assembly 17. Since these printheads have been assembled in the factory, the specified alignment may be enough.

A preferred embodiment of this timing method includes providing additional data. When printhead assembly 17 is built in the factory, the automated test and vision system described above is used to calculate the exact relative positioning of droplets ejected from printheads 79. Then, positioning data is recorded on information storage device or memory element 78. Information storage device 78 is preferably attached to printhead assembly 17, but may also be provided separately to printing system 10.

The printing system 10 uses data from information storage device 78 to assure proper droplet positioning using an x and y axis system that corresponds to the scan axis (axis along which the carriage scans) and the paper axis (along direction of paper advance), directions, respectively. Carriage 16 travels with velocity v in the x-direction. Printhead prints a swath that corresponds roughly with the length of an array of nozzles 82. Each time a swath is printed, the paper advances in the y-direction.

If a particular drop has a positional error of $\pm\Delta x$ along the scan direction x, then the timing can be adjusted to offset this error by the following formula:;

$\Delta t = \pm\Delta x / v_{scan}$, where $\Delta t$=delay or advance time for firing nozzles $v_{scan}$=carriage scan velocity As a result of these design options, the multiple cartridge printhead assembly offers a wide range of product implementations other than those illustrated in FIGS. 1 and 2. For example, such printhead assembly systems may be incorporated into an inkjet printer used in a facsimile machine, a copying machine or a combined facsimile/copying machine.

While particular embodiments of the present invention have been shown and described, it will be obvious to those skilled in the art that changes and modifications may be made within departing from this invention in its broader aspects and, therefore, the appended claims are to encompass within their scope all such changes and modifications as fall within the true spirit and scope of this invention.

What is claimed is:

1. A printing system, comprising:

a first substrate having a first array of ink ejection elements formed on a surface of said first substrate for ejecting droplets of a first ink;

a second substrate having a second array of ink ejection elements formed on a surface of said second substrate for ejecting droplets of a second ink;

a first housing having said first substrate mounted thereon, said first housing having first electrical contacts connected to said first substrate;

a second housing having said second substrate mounted thereon, said second housing having second electrical contacts connected to said second substrate;

a memory element located on said first housing, said memory element being in electrical connection with a memory electrical contact on said first housing, said memory element containing x-axis alignment parameters that relate droplet ejection characteristics of said first array of ink ejection elements and said second array of ink ejection elements;

means for affixing said first and second housings together to form a print cartridge assembly; and a scanning carriage to which said print cartridge assembly is mounted, said scanning carriage having carriage electrical contacts in electrical connection to the first and second electrical contacts on said first and second housings.

2. The printing system of claim 1 further including a microprocessor electrically connected to the scanning carriage wherein the x-axis alignment parameters are used to calculate the relative alignment between said first and second arrays of ink ejection elements such that droplets of a first ink can be effectively aligned with droplets of a second ink.

3. The printing system of claim 1 wherein said memory element includes a separate storage device located on each housing in said print cartridge assembly.

4. The printing system of claim 1 wherein said memory element x-axis alignment parameters are measured for said first and second array of ink ejection elements by a test apparatus prior to mounting said print cartridge assembly in the scanning carriage.

5. A method of assembling a printing system, comprising:

providing a first array of ink ejection elements formed on a first substrate surface for ejecting droplets of a first ink;

providing a second array of ink ejection elements formed on a second substrate surface for ejecting droplets of a second ink;

forming a printhead assembly by rigidly connecting said first and second array of ink ejection elements in fixed relative positions to eliminate mis-alignment in a media advance direction;

testing said printhead assembly by calibrating the position of ink droplets on a sample printout to obtain alignment parameters that relate droplet positions of said first array of ink ejection elements and said second array of ink ejection elements in a print cartridge assembly scan direction;

providing a memory element associated with said first array of ink ejection elements and said second array of ink ejection elements; and recording on said memory element said alignment parameters.

6. The method of claim 5 further including:

reading said alignment parameters from the memory element; and calculating the relative alignment adjustment in the print cartridge scan direction between said first and second arrays of ink ejection elements such that droplets of the first ink can be effectively aligned with droplets of the second ink.

7. The method of claim 5, wherein said recording alignment parameters includes recording on said memory element parameters that relate droplet ejection characteristics of said first array of ink ejection elements and said second array of ink ejection elements.

8. The method of claim 5 wherein said recording alignment parameters includes recording on said memory element parameters that relate relative trajectories of said first array of ink ejection elements and said second array of ink ejection elements.

* * * * *